US008705790B2

(12) United States Patent
Kuze

(10) Patent No.: US 8,705,790 B2
(45) Date of Patent: Apr. 22, 2014

(54) SPEAKER DIAPHRAGM, AND SPEAKER AND HANDHELD TERMINAL DEVICE USING SAID SPEAKER DIAPHRAGM

(75) Inventor: Mitsukazu Kuze, Mie (JP)

(73) Assignee: Panasonic Corporation, Osaka (JP)

( * ) Notice: Subject to any disclaimer, the term of this patent is extended or adjusted under 35 U.S.C. 154(b) by 58 days.

(21) Appl. No.: 13/510,034

(22) PCT Filed: Dec. 3, 2010

(86) PCT No.: PCT/JP2010/007051
§ 371 (c)(1),
(2), (4) Date: May 16, 2012

(87) PCT Pub. No.: WO2011/080877
PCT Pub. Date: Jul. 7, 2011

(65) Prior Publication Data

US 2012/0237076 A1 Sep. 20, 2012

(30) Foreign Application Priority Data

Dec. 28, 2009 (JP) ..... 2009-297404

(51) Int. Cl.
*H04R 1/00* (2006.01)

(52) U.S. Cl.
USPC ..... 381/423; 381/398; 381/424; 381/426

(58) Field of Classification Search
USPC ..... 381/396–433, 398, 423, 424, 426
See application file for complete search history.

(56) References Cited

U.S. PATENT DOCUMENTS

| | | | | |
|---|---|---|---|---|
| 5,521,886 | A * | 5/1996 | Hirosawa et al. | 367/174 |
| 6,171,534 | B1 * | 1/2001 | Leach et al. | 264/102 |
| 7,433,485 | B1 * | 10/2008 | Diedrich et al. | 381/404 |
| 7,577,270 | B2 * | 8/2009 | Horigome et al. | 381/430 |
| 7,708,111 | B2 * | 5/2010 | Uryu et al. | 181/169 |
| 8,259,987 | B2 * | 9/2012 | Omoda | 381/423 |
| 8,442,259 | B2 * | 5/2013 | Williamson | 381/398 |
| 2007/0071275 | A1 * | 3/2007 | Matsuda et al. | 381/423 |
| 2011/0064260 | A1 * | 3/2011 | Andersen et al. | 381/430 |
| 2011/0317869 | A1 * | 12/2011 | Fujitani et al. | 381/423 |

FOREIGN PATENT DOCUMENTS

| | | | |
|---|---|---|---|
| JP | 61-123392 | A | 6/1986 |
| JP | 7-15793 | A | 1/1995 |
| JP | 7-162991 | A | 6/1995 |
| JP | 8-79865 | A | 3/1996 |
| JP | 8-118421 | A | 5/1996 |
| JP | 2000-201396 | A | 7/2000 |

OTHER PUBLICATIONS

International Search Report for PCT/JP2010/007051, Feb. 22, 2011.

* cited by examiner

*Primary Examiner* — Curtis Kuntz
*Assistant Examiner* — Ryan Robinson
(74) *Attorney, Agent, or Firm* — RatnerPrestia

(57) ABSTRACT

A speaker diaphragm includes a body vibrating to generate a sound, an edge fusion-bonded to an outer circumference portion of the body, a projection provided on an upper surface of the edge, and a gasket provided on a lower surface of the edge. The edge is made of material different from that of the body. The projection is made of material identical to that of the edge. The gasket is made of material identical to that of the body. A speaker including the diaphragm has waterproof property by itself.

10 Claims, 6 Drawing Sheets

FIG. 6 PRIOR
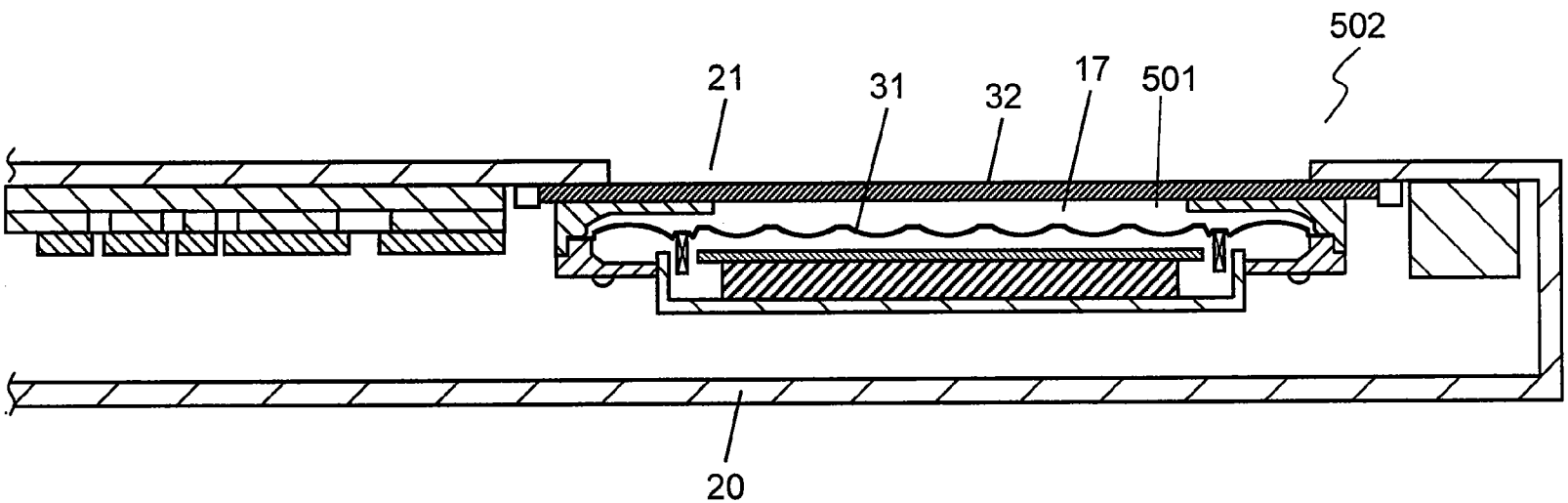

SPEAKER DIAPHRAGM, AND SPEAKER AND HANDHELD TERMINAL DEVICE USING SAID SPEAKER DIAPHRAGM

TECHNICAL FIELD

The present invention relates to a speaker to be used in various portable terminal devices.

BACKGROUND ART

FIG. 5 is a sectional view of conventional speaker 501 that includes diaphragm 31 made of thin film. Voice coil 14 is fixed to a lower surface of diaphragm 31. Yoke 8, magnet 9, and plate 10 constitute magnetic circuit 11 that has magnetic gap 11 into which a lower end of voice coil 14 is inserted.

FIG. 6 is a schematic sectional view of portable phone 502 including speaker 501. Portable phone 502 has waterproof property. Speaker 501 includes with waterproof sheet 32, made of moisture-transmissive and water proof material in order to prevent water from entering therein through set sound-radiating hole 21 and speaker sound-radiating hole 17.

If entire portable phone 502 has waterproof property, diaphragm 31 can hardly have strength enough against water entering therein, so that diaphragm 31 may be broken and encountered by water entering therein.

It is thus needed to seal sound-radiating hole 17 with a water-proof sheet made of moisture-transmissive and water proof material in order to provide speaker 501 with the waterproof property. However, the foregoing structure probably invites an abnormal sound generated by vibration of the waterproof sheet due to a sound pressure from diaphragm 31, or the sound radiated from diaphragm 31 might be blocked, thereby degrading acoustic characteristics.

On top of that, it is a cumbersome work to stick the waterproof sheet with accuracy to portable phone 502, whereby the yield can be lowered or waterproof reliability can be degraded. The waterproof sheet raises the cost of the speaker.

Conventional speakers similar to speaker 501 are disclosed in Patent Literatures 1 and 2.

CITATION LIST

Patent Literature

Patent Literature 1: Japanese Patent Laid-Open Publication No. 2000-201396

Patent Literature 2: Japanese Patent Laid-Open Publication No. 08-079865

SUMMARY OF THE INVENTION

A speaker diaphragm includes a body vibrating to generate a sound, an edge fusion-bonded to an outer circumference portion of the body, a projection provided on an upper surface of the edge, and a gasket provided on a lower surface of the edge. The edge is made of material different from that of the body. The projection is made of material identical to that of the edge. The gasket is made of material identical to that of the body.

A speaker including the diaphragm has waterproof property by itself.

BRIEF DESCRIPTION OF THE DRAWINGS

FIG. 6 is a schematic sectional view of a portable terminal device having the conventional speaker mounted thereto.

DETAIL DESCRIPTION OF PREFERRED EMBODIMENT

Figure 1A:
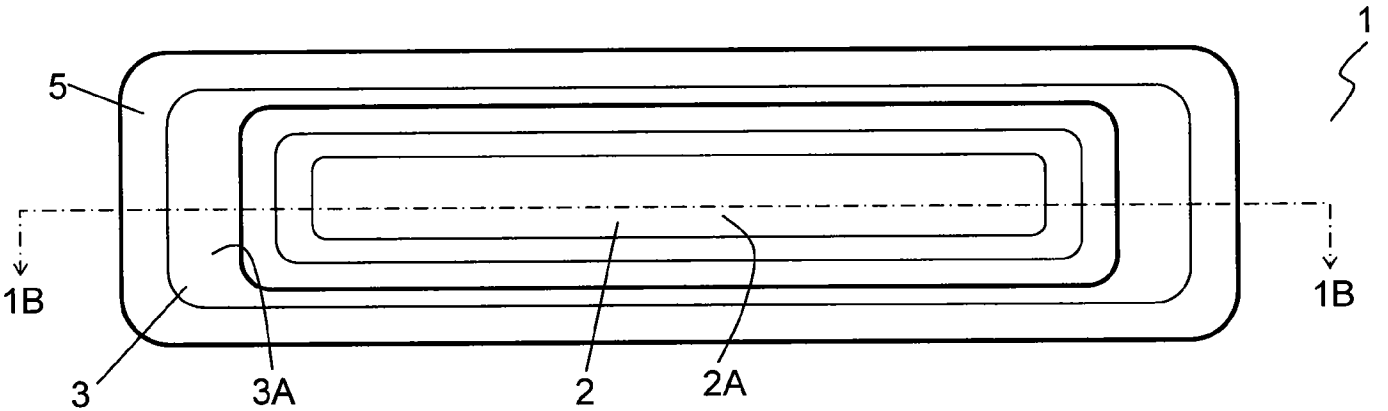
FIG. 1A is a top view of a speaker diaphragm in accordance with an exemplary embodiment of the present invention.
Figure 1B:
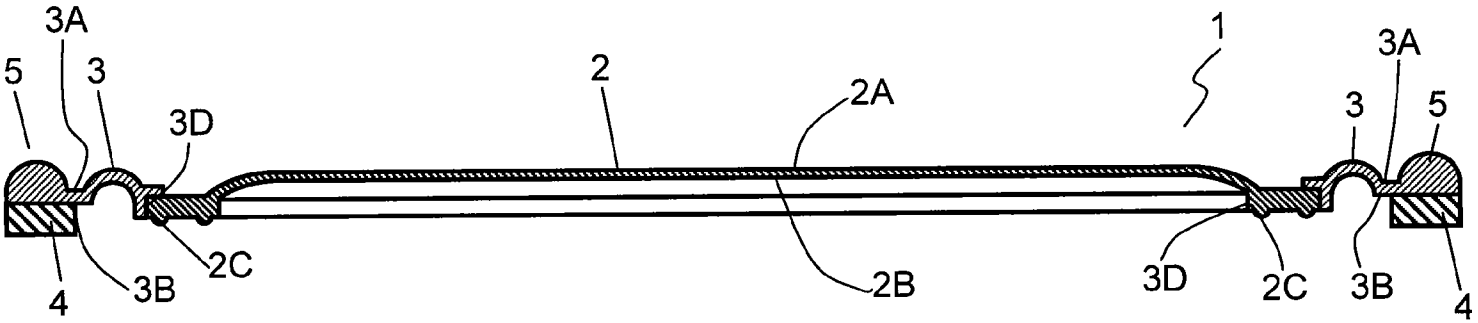
FIG. 1B is a sectional view of the speaker diaphragm on line 1B-1B shown in FIG. 1A

FIG. 1A is a top view of speaker diaphragm 1 in accordance with an exemplary embodiment of the present invention. FIG. 1B is a sectional view of the speaker diaphragm on line 1B-1B shown in FIG. 1A. Diaphragm 1 includes body 2, edge 3, gasket 4, and projection 5 formed on upper surface 3A of edge 3.

Speaker diaphragm 1 is molded by a double-molding method. To be more specific, in a first molding, body 2 and gasket 4 are formed by molding the same material with a mold simultaneously, which is a first molding. Then, in a second molding, edge 3 and projection 5 are formed simultaneously by molding the material different from the material of body 2 and gasket 4. The material of body 2 and gasket 4 is resin material, such as polypropylene, while the material for edge 3 and projection 5 is low-elastic material, such as elastomer, having a small elasticity. These materials are selected considering flexibility, air-tightness, and acoustic characteristics depending on the needs of usage.

Figure 5:
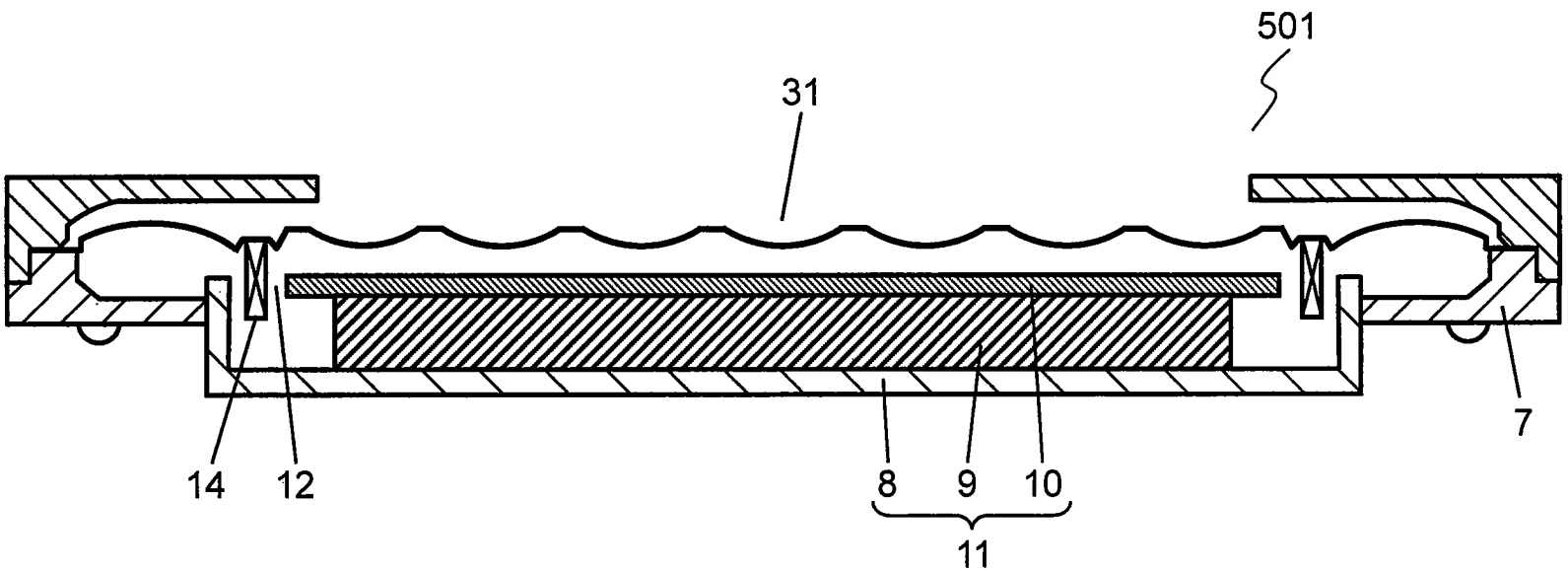
FIG. 5 PRIOR ART
FIG. 5 is a sectional view of a conventional speaker.

Diaphragm 1 is different from diaphragm 31 of conventional speaker 501 shown in FIG. 5 in that edge 3 and body 2 are made of materials different from each other, and body 2 has high rigidity while edge 3 has low stiffness. Diaphragm 1 thus resists deformation or breakage, and has high waterproof property even if it is splashed with water or immersed in water and subjected to a hydraulic pressure.

Edge 3 is formed by molding material, such as elastomer, having much smaller elasticity than the film material used for diaphragm 31 of conventional speaker 501. Edge 3 can be thicker than conventional diaphragm 31 although they have the same stiffness. Edge 3 is thus sturdier than conventional diaphragm 31 and more reliable for hydraulic pressure.

In the case that edge 3 is fixed to body 2 with an adhesive, the adhesive cannot be applied completely uniformly or be free from any gap between edge 3 and body 2. The adhesive may degrade due to aging, and the degradation incurs gaps between edge 3 and body 2. When diaphragm 31 is splashed with water, the water may enter through the gap.

Diaphragm 1 in accordance with this embodiment is formed by the double molding, thereby fusion-bonding inner circumference portion 3D of edge 3 to outer circumference portion 2C of body 2 with heat. If diaphragm 1 is splashed with water, the water cannot enter between edge 3 and body 2, thus providing waterproof reliability.

Since edge 3 is made of material having small elasticity, and is so flexible that edge 3 can hardly be handled. Gasket 4 is fusion-bonded with heat onto lower surface 3B of edge 3, so that diaphragm 1 can be handled easily. Since gasket 4 is fusion-bonded to edge 3 with heat, they gasket 4 and edge 3 are prevented from being peeled off, so that stable stiffness can be expected, which allows stabilizing the lowest resonant frequency f0 of the speaker.

When the speaker is assembled, projection 5 is pressurized and compressed to function as a packing. To be more specific, if water enters from upper surface 2A of diaphragm 1, projection 5 blocks the water and prevents the water from entering outside projection 5.

In FIG. 1B, a cross section of projection 5 has a semicircular shape; however, it can have an oval, rectangle, or triangle shape. A designer can select any shape in view of the waterproof effect.

Projection 5 is made of the same material as edge 3, and projection 5 and edge 3 are molded simultaneously by the double molding method, so that no gaps are produced between edge 3 and projection 5. Projection 5 thus is more reliable in submersion than projection 5 made of a sealing member formed separately from edge 3.

Figure 2:
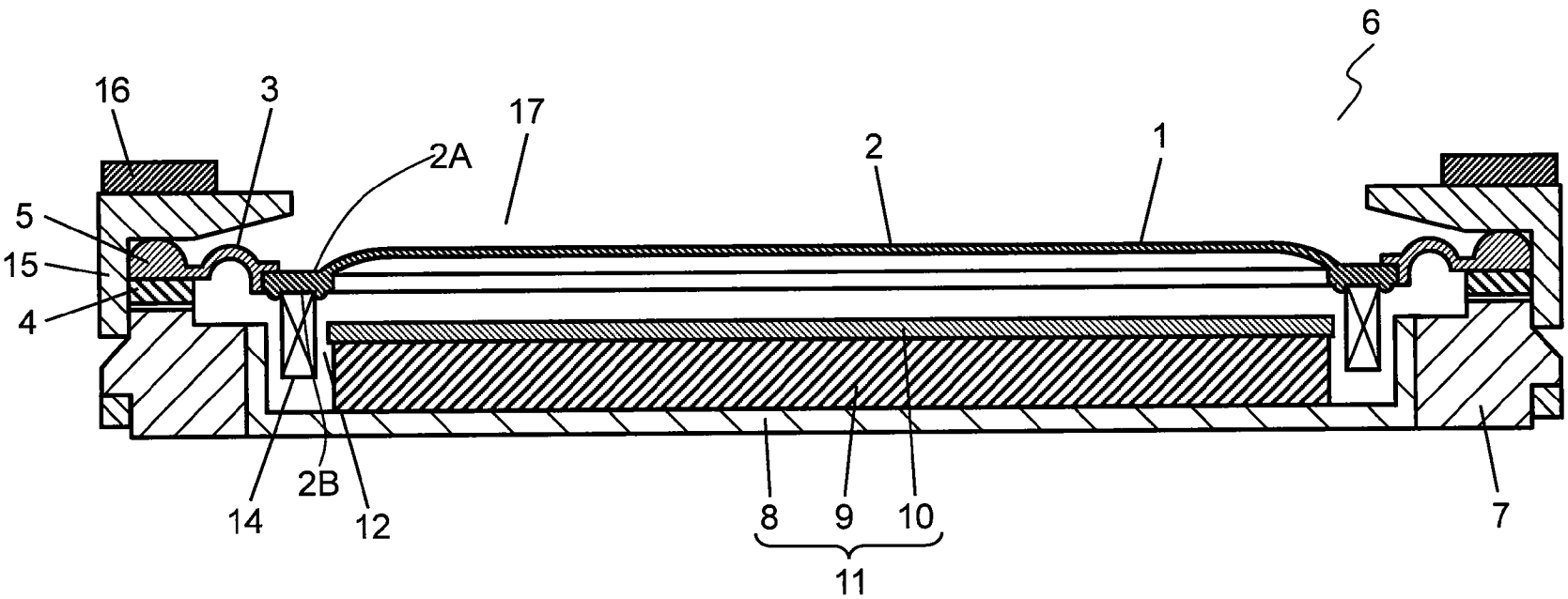
FIG. 2 is a sectional view of a speaker in accordance with the embodiment.
Figure 3:
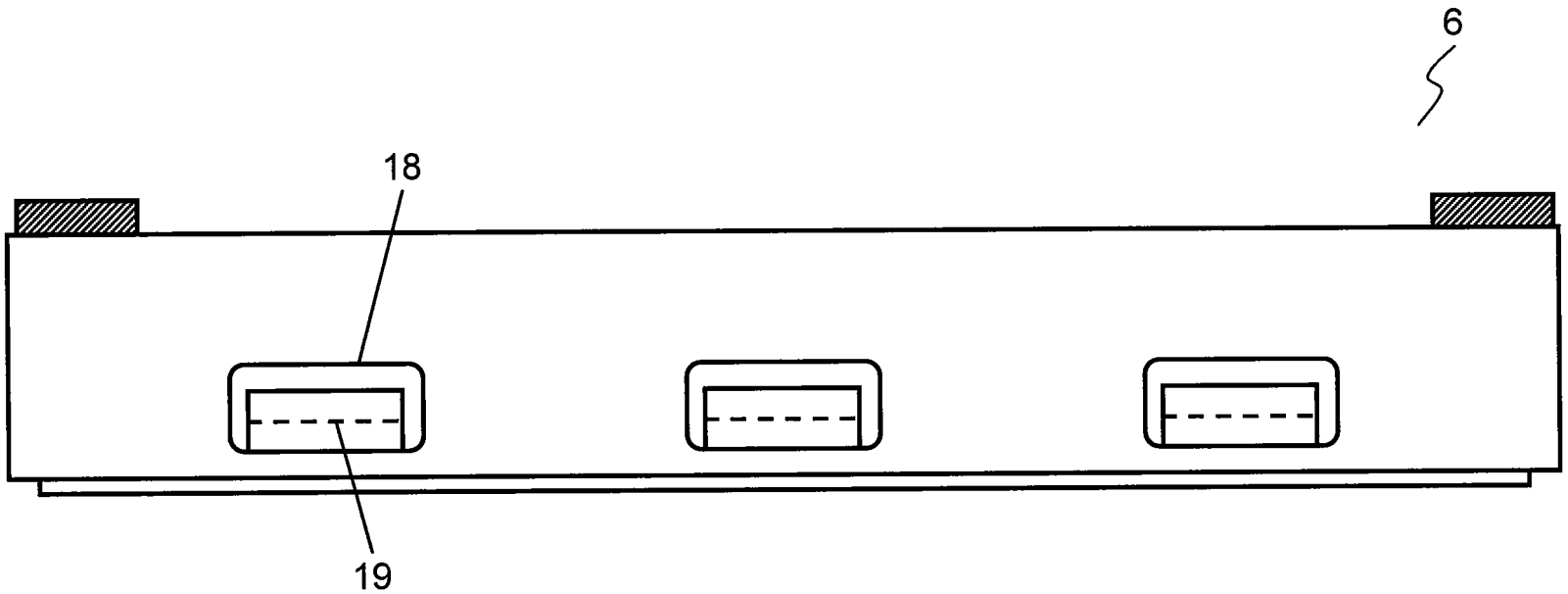
FIG. 3 is a side view of the speaker in accordance with the embodiment.

FIGS. 2 and 3 are a sectional view and a lateral view of speaker 6 including diaphragm 1 shown in FIG. 1B, respectively. Speaker 6 includes frame 7, yoke 8, magnet 9, plate 10, voice coil 14, protector 15, and packing 16 having waterproof property. Sound radiating hole 17 is provided in protector 15. Protector 15 contacts projection 5. As shown in FIG. 3, protector 15 has fitting holes 18 therein, and frame 7 has fitting sections 19.

The structure and operation of speaker 6 in accordance with the embodiment will be described below. Yoke 8, magnet 9, and plate 10 constitute magnetic circuit 11 having magnetic gap 12 for generating a magnetic field. Voice coil 14 is inserted into magnetic gap 12.

Upon an audio signal flowing through voice coil 14, the magnetic field of magnetic gap 12 causes voice coil 14 to vibrate vertically according to the Fleming's left-hand rule.

Voice coil 14 is fixed onto lower surface 2B of body 2, and the vibration of voice coil 14 works to air via body 2, thereby radiating a sound.

Edge 3 supports body 2 such that body 2 can vibrate normally in a direction perpendicular to upper surface 2A and lower surface 2B of body 2, and also shuts off a sound generated from lower surface 2B having a phase reverse to that of the sound generated from upper surface 2A. This shut-off prevents the sound in the reverse-phase from interfering with the sound generated from upper surface 2A due to diffraction.

An effect and advantage of speaker 6 in accordance with this embodiment will be described below. Projection 5 is sandwiched between gasket 4 and protector 15, thereby being compressed appropriately and attached securely to protector 15. This structure allows projection 5 to block the water to enter through sound-radiating hole 17. If the water enters between projection 5 and protector 15 to an inside of a portable terminal device to which speaker 6 is mounted, an electric circuit therein can be shorted, corroded and broken. The structure of speaker 6 prevents the water from flowing over projection 5 and entering inside the portable terminal device to which speaker 6 is mounted.

As shown in FIG. 3, fitting sections 19 provided on frame 7 is engaged with fitting holes 18 provided in protector 15 by hooking holes 18 over fitting sections 19, so that frame 7 and protector 15 are joined together and projection 5 can be compressed securely. Protector 15 is made of resin; however, it can be made of another material, such as metal. Protector 15 and frame 7 are not necessarily joined together by engaging the fitting sections 19 with the fitting holes 18, for instance, they can be joined together by another structure, such as an adhesive.

Nothing exists in front of protector 15 of speaker 6 shown in FIG. 3, so that diaphragm 1 is exposed through sound radiating hole 17. Plural sound-radiating holes can be provided in protector 15 to protect diaphragm 1, or a mesh can be bonded to protector 15 for covering sound radiating hole 17 to protect diaphragm 1.

Speaker 6 shown in FIG. 3 includes the magnetic circuit of an inner magnet type; however, may include a magnetic circuit of an outer magnet type. Speaker 6 can have a circular, rectangular, or track shape.

Figure 4:
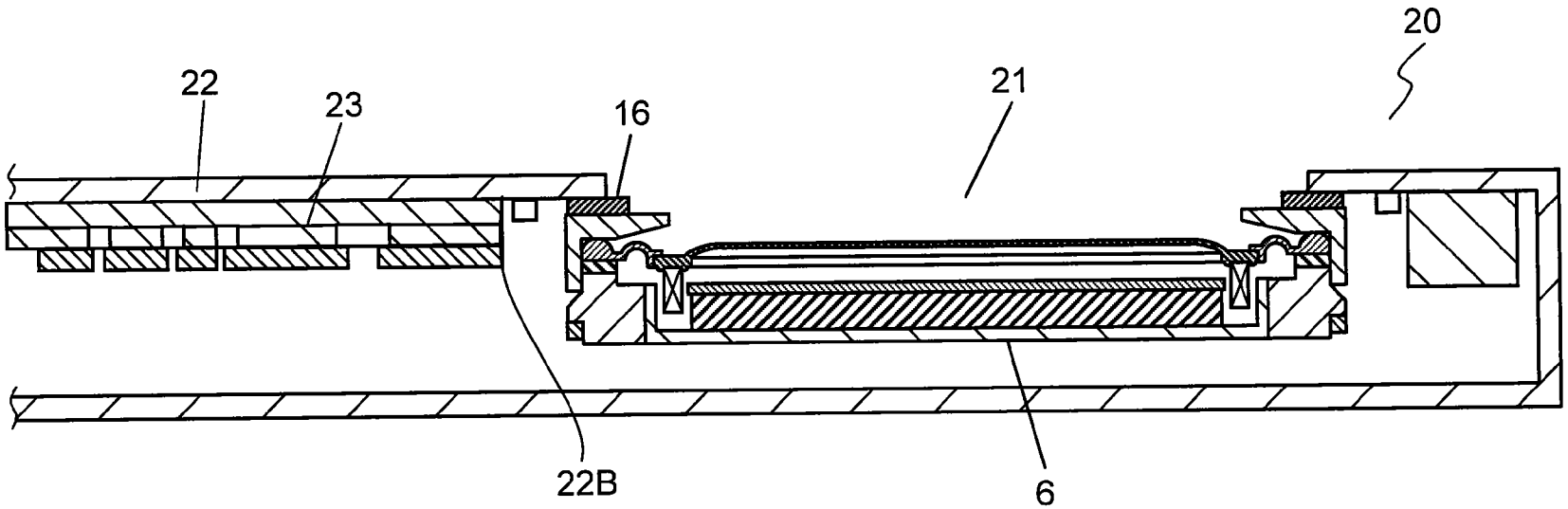
FIG. 4 is a schematic sectional view of a portable phone having the speaker in accordance with the embodiment mounted thereto.

FIG. 4 is a schematic sectional view of portable terminal device 20 according to the embodiment to which speaker 6 shown in FIG. 2 is mounted. Portable terminal device 20 includes speaker 6, housing 22 in which speaker 6 is mounted, and electronic circuit 23 connected to speaker 6. Housing 22 has set-sound radiating hole 21 therein.

An appropriate pressure is applied behind speaker 6 such that it can compress packing 16, thereby speaker 6 is joined to inner wall surface 22B of housing 22 while speaker 6 compresses packing 16. The sound generated from diaphragm 1 transmits through sound radiating hole 17 provided in protector 15 and set-sound radiating hole 21 provided in housing 22, and then, is radiated outside housing 22. Even if water enters through set-sound radiating hole 21, compressed packing 16 prevents the water from entering inside portable terminal device 20 via an upper surface of protector 15. If the water enters through set-sound radiating hole 21, projection 5 surrounding edge 3 of speaker 6 prevents the water from entering inside portable terminal device 20.

Body 2 has a higher rigidity than edge 3. Edge 3 is made of elastic material having a smaller elasticity than body 2, and has an appropriate thickness. Since diaphragm 1 is molded by the double molding method, the joint surfaces between edge 3 and body 2 is fusion bonded securely with heat. The joint surfaces cannot be broken by a hydraulic pressure, and water cannot enter between the joint surfaces. Waterproof packing 16 can be made of a component, such as a packing, a rubber ring, an O-ring, a sealing member, or an adhesive, having waterproof property.

Portable terminal device 20 shown in FIG. 4 has set-sound radiating hole 21 therein directly facing the outside of portable terminal device 20, so that diaphragm 1 is exposed outside housing 22 through set-sound radiating hole 21. Plural sound-radiating holes may be formed in housing 22 such that the holes face diaphragm 1 or sound-radiating hole 17 in order to protect diaphragm 1 or prevent dust from entering. A dustproof net or mesh which does not adversely affect the sound quality can be attached onto housing 22 to cover set-sound radiating hole 21.

Portable terminal device 20 in accordance with this embodiment is applicable to not only a portable phone and a portable information terminal but also any device, such as a game device, a portable audio device, which generates a sound.

As discussed above, speaker diaphragm 1 and speaker 6 in accordance with the embodiment can be strong enough against water since diaphragm 1 is molded by the double molding method, and the water never enters speaker 6 since edge 3 is bonded securely to body 2.

The speaker does not require a waterproof sheet, typically made of moisture-transmissive and waterproof material, for sealing the sound radiating hole of the speaker in order to make the speaker waterproof. The waterproof sheet may provide problems. For example, the waterproof sheet is buffeted by a sound pressure and produces abnormal sounds, or the waterproof sheet interferes with the sound radiated, which degrades the acoustic characteristics. The speaker according to the embodiment eliminates these problems caused by the waterproof sheet.

Cumbersome work, i.e. sticking the waterproof sheet to the set or the speaker with accuracy, can be avoided, so that a lower yield or a lower reliability regarding the waterproof property can be also avoided. Since the waterproof sheet is not necessary, speaker 6 can be produced at a lower cost.

Speaker 6 thus obtains waterproof property by itself, so that it can be useful for providing portable terminal device 20 with waterproof property.

Since diaphragm 1 is injection-molded and is not made of thin film, it has an appropriate thickness and a large rigidity. Diaphragm 1 is thus prevented from deforming and breaking even if it is splashed with water, or immersed in the water and subjected to a hydraulic pressure. As a result, the waterproof property can be improved.

Edge 3 is formed by molding elastomer having an extremely smaller elastic coefficient than film material that is used in conventional speaker diaphragm 31 shown in FIG. 5. Edge 3 of diaphragm 1 can be thicker than conventional diaphragm 31 having the same stiffness, so that diaphragm 1 can be rigid and reliable to a hydraulic pressure.

Projection 5 made of the same material as edge 3 functions as a waterproof packing, so that it can prevent water from entering inside portable terminal device 20 to which speaker 6 is mounted.

As discussed above, in speaker diaphragm 1, body 2 has outer circumference portion 2C and vibrates for generating a sound. Edge 3 has inner circumference portion 3D is fusion-bonded onto outer circumference portion 2C of body 2, but is made of material different from that of body 2. Projection 5 is formed on upper surface 3A of an outer circumference portion of edge 3 and made of the same material as that of body 2. Gasket 4 is provided on an opposite side to projection 5.

In speaker 6, voice coil 14 is rigidly mounted to lower surface 2B of body 2 of diaphragm 1. Magnetic circuit 11 has magnetic gap 12 into which voice coil 14 is inserted. Protector 15 contacts projection 5 of diaphragm 1. Diaphragm 1 is rigidly mounted between frame 7 and protector 15 such that projection 5 is compressed between gasket 4 and protector 15. Protector 15 is made of resin or metal. Packing 16 is provided on an upper surface of a periphery of protector 15 and has waterproof property.

In portable terminal device 20 structure, speaker 6 is mounted to housing 22. Packing 16 is compressed by protector 15 of speaker 6 and housing 22.

In this embodiment, terms, such as "upper surface" and "lower surface" suggesting directions indicate relative directions depending on the positional relation of structural elements, such as body 2 and edge 3, of speaker diaphragm 1, and do not indicate absolute directions, such as a vertical direction.

INDUSTRIAL APPLICABILITY

A speaker diaphragm and a speaker according to the present invention are excellent in waterproof property, so that they are useful for waterproof portable terminal devices.

DESCRIPTION OF REFERENCE MARKS

1 Speaker Diaphragm
2 Body
3 Edge
4 Gasket
5 Projection
6 Speaker
7 Frame
11 Magnetic Circuit
12 Magnetic Gap
14 Voice Coil
15 Protector
16 Packing
20 Portable Terminal Device

The invention claimed is:

1. A speaker comprising:
a speaker diaphragm including
a body having an outer circumference portion and vibrating to generate a sound,
an edge provided on the outer circumference portion of the body, the edge being made of material different from material of the body, and molded together with the body by a double molding,
a projection provided on an upper surface of the edge, the projection being made of material identical to the material of the edge, and
a gasket provided on a lower surface of the edge, the gasket being made of material identical to the material of the body:
a voice coil fixed onto a lower surface of the body of the speaker diaphragm;
a magnetic circuit having a magnetic gap into which the voice coil is inserted;
a protector contacting the projection of the speaker diaphragm; and
a frame fixes the diaphragm between the protector and the frame such that the projection is compressed by the gasket and the protector.

2. The speaker according to claim 1,
wherein the projection is provided at an outer circumference portion of the edge, and
wherein the gasket is provided on an opposite side to the edge.

3. The speaker according to claim 1, wherein the protector is made of resin or metal.

4. The speaker according to claim 1, further comprising a waterproof packing provided on an upper surface of an outer circumference portion of the protector.

5. A portable terminal device comprising:
the speaker according to claim 4; and
a housing to which the speaker is mounted;
wherein the packing is compressed by the protector of the speaker and the housing.

6. A speaker comprising:
a speaker diaphragm including
a body having an outer circumference portion and vibrating to generate a sound,
an edge fusion-bonded onto the outer circumference portion of the body, the edge being made of material different from material of the body,
a projection provided on an upper surface of the edge, the projection being made of material identical to the material of the edge, and
a gasket provided on a lower surface of the edge, the gasket being made of material identical to the material of the body;
a voice coil fixed onto a lower surface of the body of the speaker diaphragm;
a magnetic circuit having a magnetic gap into which the voice coil is inserted;
a protector contacting the projection of the speaker diaphragm; and a frame fixes the diaphragm between the protector and the frame such that the projection is compressed by the gasket and the protector.

7. The speaker according to claim 6, wherein the projection is provided at an outer circumference portion of the edge, and wherein the gasket is provided on an opposite side to the edge.

8. The speaker according to claim 6, wherein the protector is made of resin or metal.

9. The speaker according to claim 6, further comprising a waterproof packing provided on an upper surface of an outer circumference portion of the protector.

10. A portable terminal device comprising:

the speaker according to claim 9; and a housing to which the speaker is mounted;

wherein the packing is compressed by the protector of the speaker and the housing.

* * * * *